US006842146B2

(12) United States Patent
Alexeff et al.

(10) Patent No.: US 6,842,146 B2
(45) Date of Patent: Jan. 11, 2005

(54) PLASMA FILTER ANTENNA SYSTEM

(75) Inventors: Igor Alexeff, Oak Ridge, TN (US); Elwood Norris, Poway, CA (US); Theodore Anderson, Brookfield, MA (US)

(73) Assignee: Markland Technologies, Inc., Ridgefield, CT (US)

( * ) Notice: Subject to any disclaimer, the term of this patent is extended or adjusted under 35 U.S.C. 154(b) by 0 days.

(21) Appl. No.: 10/084,259

(22) Filed: Feb. 25, 2002

(65) Prior Publication Data

US 2003/0160724 A1 Aug. 28, 2003

(51) Int. Cl.[7] ..... H01Q 23/00; H01Q 19/19
(52) U.S. Cl. ..... 343/701; 343/909; 333/99 PL
(58) Field of Search ..... 333/99 PL; 343/701, 343/754, 909

(56) References Cited

U.S. PATENT DOCUMENTS

| | | | | |
|---|---|---|---|---|
| 3,212,034 A | * | 10/1965 | Kaufman et al. | 333/99 PL |
| 3,238,531 A | * | 3/1966 | Kaufman et al. | 343/754 X |
| 3,404,403 A | | 10/1968 | Vallese et al. | 343/700 |
| 3,719,829 A | | 3/1973 | Vaill | 343/700 |
| 4,028,707 A | | 6/1977 | Young et al. | 343/719 |
| 4,062,010 A | | 12/1977 | Young et al. | 343/719 X |
| 5,594,456 A | | 1/1997 | Norris et al. | 343/701 |
| 5,963,169 A | | 10/1999 | Anderson et al. | 343/701 |
| 5,990,837 A | | 11/1999 | Norris et al. | 343/701 |
| 6,046,705 A | | 4/2000 | Anderson | 343/834 |
| 6,087,992 A | | 7/2000 | Anderson | 343/701 |
| 6,087,993 A | | 7/2000 | Anderson et al. | 343/701 |
| 6,118,407 A | | 9/2000 | Anderson | 343/701 |
| 6,169,520 B1 | | 1/2001 | Anderson | 343/701 |
| 6,369,763 B1 | | 4/2002 | Norris et al. | 343/701 |

FOREIGN PATENT DOCUMENTS

| | | |
|---|---|---|
| WO | WO 00/21156 | 4/2000 |

* cited by examiner

*Primary Examiner*—Benny T. Lee
(74) *Attorney, Agent, or Firm*—Thorpe North & Western, LLP

(57) ABSTRACT

An antenna system for receiving electromagnetic waves of predetermined frequency range is disclosed comprising an antenna configured for receiving electromagnetic waves; and a plasma filter configured for reflecting a first electromagnetic frequency emitted from a remote source, while at the same time passing a second electromagnetic frequency, such that one of the first electromagnetic frequency and the second electromagnetic frequency is received by the antenna. The electromagnetic wave filter can comprise a power medium positioned with respect to a region of space; a composition disposed within the region of space for forming a plasma; an energy source electromagnetically coupled to the power medium such that a plasma may be formed in the region of space; and a control mechanism for varying plasma density within the region of space, wherein the plasma density will reflect a first electromagnetic frequency emitted from a remote source, while at the same time passing a second electromagnetic frequency.

32 Claims, 3 Drawing Sheets

PLASMA FILTER ANTENNA SYSTEM

FIELD OF THE INVENTION

The present invention relates generally to antenna and electromagnetic wave filter systems. More particularly, the present invention relates to electromagnetic filters for allowing certain wavelengths or frequencies to pass through while others are reflected, thus protecting the antenna element(s) from electronic warfare tactics.

BACKGROUND OF THE INVENTION

Since the inception of electromagnetic theory and the discovery of radio frequency transmission, antenna design has been an integral part of virtually every telemetry application. Countless books have been written exploring various antenna design factors such as geometry of the active or conductive element, physical dimensions, material selection, electrical coupling configurations, multi-array design, and electromagnetic waveform characteristics such as transmission wavelength, transmission efficiency, transmission waveform reflection, etc. Technology has advanced to provide unique antenna designs for applications ranging from general broadcast of RF signals for public use to weapon systems of highly complex nature.

Prior to the issuance of U.S. Pat. Nos. 5,594,456 and 5,990,837 of the present inventor, there were two particular areas of prior art related to the present invention. First, U.S. Pat. Nos. 4,028,707 and 4,062,010 illustrate various antenna structures consisting of wire and metal conductors that are appropriately sized for antenna operation with ground penetrating radar. Second, U.S. Pat. Nos. 3,404,403 and 3,719,829 describe the use of a plasma column formed in air by laser radiation as the antenna transmission element.

In its most common form, the antenna represents a conducting wire that is sized to radiate or receive signals at one or more selected frequencies. To maximize effective radiation of such energy, the antenna is adjusted in length to correspond to a resonating multiplier of the wavelength or frequency to be transmitted. Accordingly, typical antenna configurations will be represented by quarter, half, and full wavelengths of the desired frequency. Effective radiation means that the signal is transmitted efficiently. Efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. The antenna will then resonate with RF radiation at some multiple of the length of the antenna.

Reflector antennas have been in use since about the time of discovery of electromagnetic wave propagation by Hertz. However, many years later when radar applications began evolving rapidly, the demand for reflectors caused many different designs to be fabricated. Additionally, reflectors for use in radio astronomy, microwave communication, and satellite tracking has resulted in great progress in the development of sophisticated analytical and experimental techniques in shaping the reflector surfaces and optimizing illumination over their apertures so as to maximize gain. Though reflectors take on many different shapes and sizes, popular shapes are plane, corner, and curved reflectors (especially the paraboloid). Additionally, similar structures have been used to provide electromagnetic shielding. For example, a reflector can be placed in front of an object to shield it from electromagnetic radiation.

SUMMARY OF THE INVENTION

It has been recognized that it would be advantageous to develop a filter system for selectively allowing certain electromagnetic wave frequency ranges to pass, while preventing other electromagnetic wave frequency ranges from passing. Thus, the present inventions provide an electromagnetic wave filter and a plasma antenna filter system for selectively receiving specific ranges of electromagnetic waves.

In accordance with a more detailed aspect of the present invention, the system includes an electromagnetic wave filter comprising a power medium positioned with respect to a region of space; a composition disposed within the region of space for forming a plasma; an energy source electromagnetically coupled to the power medium such that a plasma may be formed in the region of space; and a control mechanism for selecting and regulating plasma density within the region of space to reflect a first electromagnetic signal frequency emitted from a remote source, while at the same time passing a second electromagnetic signal frequency.

In accordance with another more detailed aspect of the present invention, an antenna system for receiving electromagnetic waves can comprise an antenna configured for receiving electromagnetic waves; and a plasma filter associated with the antenna and configured for reflecting a first electromagnetic signal frequency emitted from a remote source, while at the same time passing a second electromagnetic signal frequency, such that either the first electromagnetic signal frequency or the second electromagnetic signal frequency is received by the antenna.

In accordance with another embodiment of the present invention, a method for selectively receiving an electromagnetic signal from a remote source can comprise the steps of identifying a desired electromagnetic signal frequency to be received from at least one remote source emitting multiple electromagnetic signal frequencies, including the desired electromagnetic signal frequency and at least one undesired electromagnetic signal frequency; generating a plasma that reflects a first electromagnetic signal frequency emitted from the remote source, while at the same time passing a second electromagnetic signal frequency, either the first electromagnetic signal frequency or the second electromagnetic signal frequency being the desired electromagnetic signal frequency; and positioning an antenna with respect to the plasma such that the desired electromagnetic signal frequency is received by the antenna, and the undesired electromagnetic signal frequency is not substantially received by the antenna.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

In the accompanying drawings which illustrate embodiments of the invention.

DETAILED DESCRIPTION OF THE INVENTION

Figure 1:
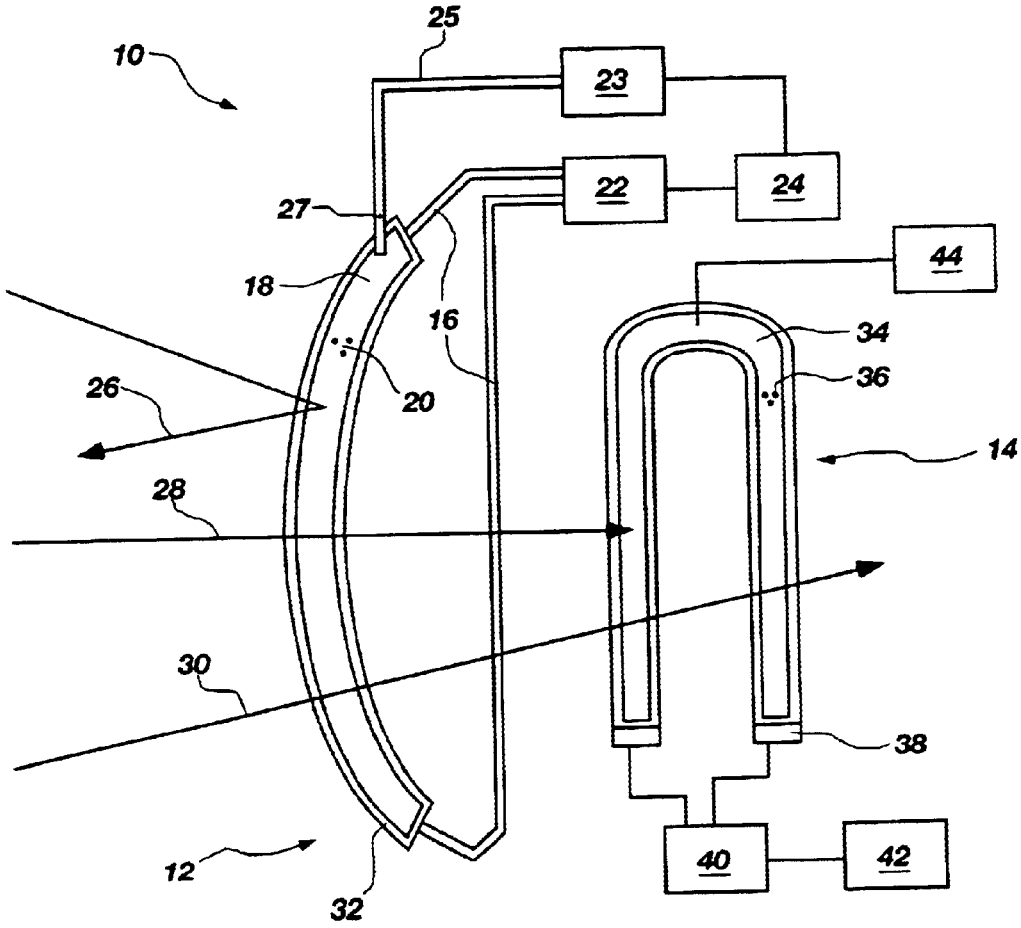
FIG. 1 is a schematic representation of a system of the present invention wherein low frequency electromagnetic waves are reflected by a plasma filter and high frequency electromagnetic waves are not absorbed by a plasma antenna.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

It must be noted that, as used in this specification and the appended claims, singular forms of "a," "an," and "the" include plural referents unless the content clearly dictates otherwise.

As illustrated in FIG. 1, an antenna system 10 for receiving electromagnetic waves of a predetermined frequency range is shown. The system can comprise an electromagnetic wave filter 12 and an antenna element 14. In the embodiment shown, the antenna element 14 can be configured for receiving electromagnetic waves and the electromagnetic wave filter 12 can be configured for reflecting undesired electromagnetic waves of a first undesired frequency range away from the antenna. However, in another embodiment, the antenna element 14 could be configured for receiving desired electromagnetic waves reflected from the electromagnetic wave filter 12, while undesired electromagnetic waves are allowed to pass through the filter 12. The electromagnetic wave filter 12 is preferably a plasma reflector that reflects certain wave frequencies and allows certain other wave frequencies to pass through. Optionally, the electromagnetic wave filter can interact with electromagnetic frequency causing phase shifting either with respect to reflected energy, or wave energy that is allowed to pass through the electromagnetic wave filter 12.

In one embodiment, the electromagnetic wave filter 12 can comprise a power medium 16 positioned with respect to a region of space 18, wherein the region of space 18 includes a composition 20 capable of forming a plasma; an energy source 22 electromagnetically coupled to the power medium such that a plasma may be formed in the region of space 18; and a control mechanism 24 for selecting a power level of the energy source/power medium such that a plasma density formed will reflect an undesired electromagnetic signal frequency 26 emitted from a remote source, while at the same time allowing a desired electromagnetic signal frequency 28, 30 to pass through electromagnetic wave filter 12. In the embodiment shown in FIG. 1, the power medium is a plasma waveguide, such as that disclosed in U.S. Pat. No. 6,624,719, and U.S. patent application having Ser. No. 09/790,327, which are incorporated herein by reference, though other power medium devices can be used.

The antenna element 14 can be any antenna element configured for receiving electromagnetic signal, but is preferably a plasma antenna. Examples of appropriate plasma antennas that can be used include those described in U.S. Pat. Nos. 5,594,456 and 5,990,837, as well as in a U.S. Pat. No. 6,369,763, each of which are incorporated herein by reference. Of the desired electromagnetic signal frequency ranges 28, 30 that pass through the filter 12, the plasma antenna 14 can be configured to absorb only a certain frequency range of a signal. For example, if a wide range of frequency signal is emitted toward the system 10 of the present invention, then the system 10 could be configured such that the low frequency signal is reflected from of the filter 12, and the middle frequency and high frequency signal are allowed to pass through the filter. Further, the plasma antenna 14 can be configured to absorb only a specific range of the filtered signal. For example, the density of the plasma can be configured such that high frequency signal 30 passes through the antenna 14, and middle frequency signal 28 is absorbed by the antenna 14.

In a more detailed aspect of the invention, many different variables can be present with respect to the plasma electromagnetic wave filter 12. For example, though not required, the region of space of the electromagnetic wave filter is preferably in an enclosed chamber defined by walls 32. The walls 32 can be constructed of a dielectric material as is known in the art. Additionally, any shape of enclosed chamber can be constructed as desired. For example, the enclosed chamber can be configured in the shape of commonly known reflectors, such as, plane reflectors, curved reflectors, and corner reflectors. If a curved reflector shape is used, then a parabolic reflector shape can be preferred, either for protecting an antenna as shown, or for focusing reflected signal onto an antenna if it is the reflected signal that is desired for antenna reception (not shown).

In some embodiments, the plasma need only fill a portion of the chamber. For example, plasma will often only create a "skin depth" within an enclosed chamber, and it is the skin depth that effectuates electromagnetic wave reflection of certain frequencies or wavelengths of signal. However, in some embodiments, the plasma can fill the entire chamber.

Though any composition 20 capable of forming a plasma under the right conditions can be used, for practical purposes, the composition will generally be a gas selected from the group consisting of neon, xenon, argon, krypton, hydrogen, helium, mercury vapor, and mixtures thereof. Additionally, the plasma can be formed for short-pulse or continuous electromagnetic wave filtration applications.

The power medium 16 can be any system or device that is capable of causing the composition 20 to form a plasma. Though the embodiment of FIG. 1 shows a plasma waveguide power medium, other power mediums can be used to form the plasma. For example, such power mediums that can be used include electrodes, fiber optics, high frequency signal, lasers, RF heating, electromagnetic couplers, inductors, acoustic energy, and other mediums known by those skilled in the art. Additionally, the power medium 16 can be electromagnetically coupled to the composition 20 at as few as one location, or can be electromagnetically coupled to the composition at a large number of locations. In a preferred embodiment, the coupling can occur at a plurality of locations.

The power medium 16 can be used in conjunction with the energy source 22 and the control mechanism 24 to alter the density of the plasma. By altering a power variable, e.g., amplitude, frequency, etc., the plasma density can be tuned for filtering off certain frequency ranges, for example. However, other methods of altering the plasma density can be implemented as well in accordance with embodiments of the present invention. For example, by altering gas pressure within the walls 32 that define the enclosed chamber, the plasma frequency or density can be altered as well. Thus, as shown in FIG. 1, the control mechanism 24 is also configured to control a gas regulator 23. The gas regulator is interconnected to the region of space 18 (which in this embodiment is within an enclosed chamber defined by walls 32). The gas regulator can fluidly communicate with the region of space by a conduit 25 that is further regulated by a valve 27. Any pressure component can be altered such as by adjusting the amount of gas present, or by adjusting the temperature, for example.

Turning to the antenna element 14, as stated, the antenna element 14 does not have to be a plasma antenna, but can be a standard metal antenna element of any configuration known in the art. However, a metal antenna may not have the ability to absorb only a discrete frequency range of signal, and have that frequency range be adjustable. Therefore, the use of a plasma antenna is preferred. If a plasma antenna is used, the plasma antenna can comprise an enclosed chamber 34; a composition 36 contained within the enclosed chamber 34 capable of forming a plasma; and a power medium 38 electromagnetically coupled to the composition 36 for developing a plasma density within the enclosed chamber 34, thereby forming the plasma antenna 14. The power medium 38 is preferably powered by an energy source 40 that can be varied by an antenna control mechanism 42. Thus, both the antenna element 14 and electromagnetic wave filter 12 can have a control mechanism for selecting an antenna plasma density and a filter plasma density, respectively. The antenna power medium 38 shown is a pair of electrodes, though any of the power medium devices as described with respect to the plasma wave filter 12 can be used with the plasma antenna 14. Though not shown, similar to the plasma shield 12, the plasma antenna 14 can also include a means of altering the plasma gas pressure within the enclosed chamber.

In many ways, the plasma wave filter 12 and the plasma antenna 14 are similar. For example, in one embodiment, both can have walls that define an area where a composition can be modified into a plasma, both can have a power medium that is energized by an energy source and controlled by a control mechanism. However, with the plasma antenna, an additional element of a signal generator or receiver 44 electromagnetically coupled to the plasma can be present for sending and/or receiving electromagnetic signal, whereas the plasma wave filter 12 may have different shape characteristics as may be desired for a specific application.

Figure 2:
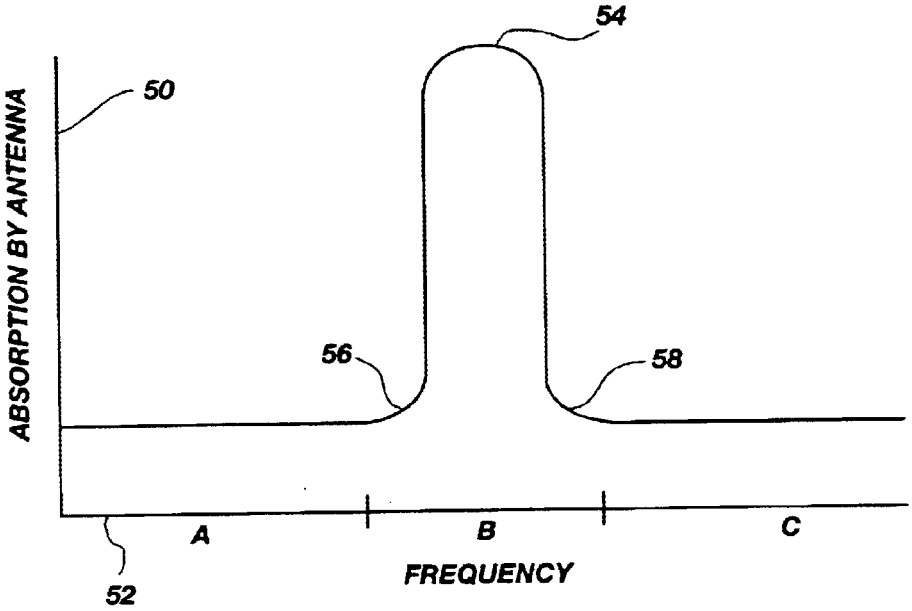
FIG. 2 is a graphical representation of the frequencies absorbed by the antenna shown in FIG. 1.

Turning now to FIG. 2, a graphical representation of the electromagnetic signal frequency range absorbed by the antenna of system 10 is shown. Specifically, an absorption axis 50 and a frequency axis 52 are shown. Region A corresponds to low frequency electromagnetic waves, region B corresponds to middle frequency electromagnetic waves, and region C corresponds to high frequency electromagnetic waves. In region A, no electromagnetic wave absorption is registered with the plasma antenna because the electromagnetic wave filter of FIG. 1 does not allow low frequency electromagnetic waves through represented by electromagnetic signal frequency 26. Likewise, in region C, no electromagnetic wave absorption is registered as the plasma antenna of FIG. 1 is configured to allow high frequency signal to pass through represented by electromagnetic signal frequency 30. In region B, all of the absorption activity is shown. Peak 54, which corresponds to middle frequency electromagnetic waves, represented by electromagnetic signal frequency 28, shows the functional range of absorption. Transition area 56 indicates the frequency range where some electromagnetic wave energy is partially filtered by the electromagnetic wave filter of FIG. 1. Likewise, transition area 58 indicates the frequency range where some electromagnetic wave energy is absorbed by the plasma antenna of FIG. 1.

Figure 3:
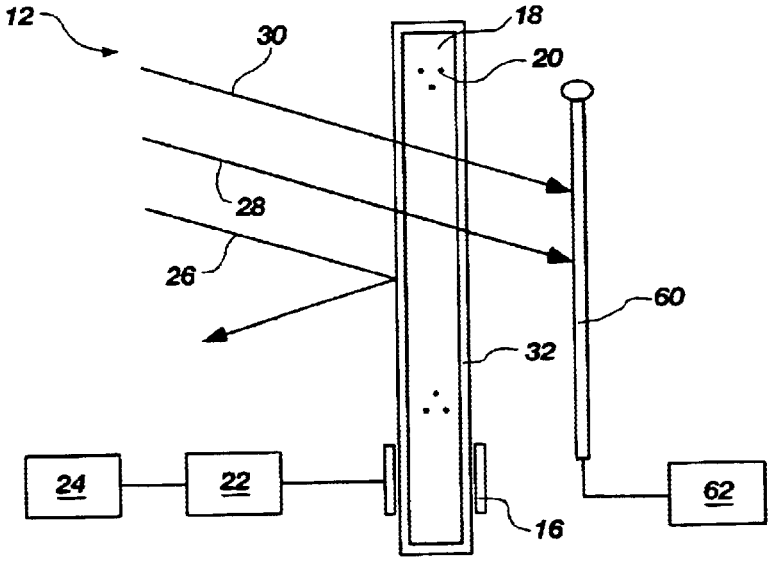
FIG. 3 is a schematic representation of an alternative embodiment wherein the electromagnetic wave filter is positioned to protect a metal antenna.

Turning now to FIG. 3, an alternative antenna system for receiving electromagnetic waves of a predetermined wave frequency is shown. In this embodiment, the electromagnetic wave filter 12 is planer. Again, the electromagnetic wave filter 12 can comprise a power medium 16 positioned with respect to a region of space 18 including a composition 20 capable of forming a plasma. The power medium 16 in this embodiment is a high power inductor at one end of the region of space 18 that can be used to energize the composition 20 to form a plasma. An energy source 22 can be electromagnetically coupled to the power medium such that a plasma may be formed in the region of space (which in this embodiment is defined by walls 32).

A control mechanism 24 for selecting a power level of the energy source/power medium is also present such that a plasma density formed will reflect an undesired electromagnetic signal frequency 26 emitted from a remote source, while at the same time allowing a desired electromagnetic signal frequency range 28, 30 through is also present. Because the antenna element 60 in this embodiment is metal, both the middle frequency signal 28 and high frequency signal 30 are detected by the antenna. A signal transmitter or receiver 62 is electromagnetically coupled to the antenna 60 as is known in the art.

Figure 4:
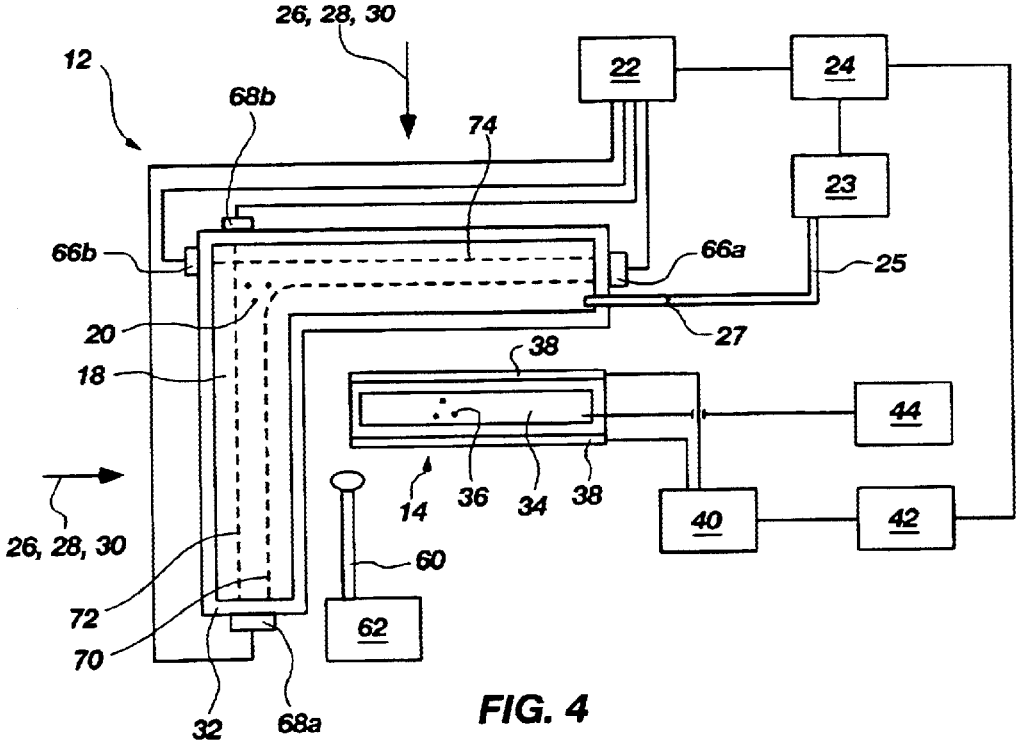
FIG. 4 is a schematic representation of yet another embodiment wherein the electromagnetic wave filter is geometrically reconfigurable and protects multiple antennas.

Turning now to FIG. 4, an alternative system is shown wherein the electromagnetic wave filter 12 can be reconfigured to a greater extent than those described in the previous figures. Though all of the electromagnetic wave filters of the present invention can be reconfigured as to plasma density, the present embodiment shown provides the ability to reconfigure the general geometry of the plasma, other than by skin depth thickness.

In this embodiment, the electromagnetic wave filter 12 is configured similar to a corner reflector. As described previously, the electromagnetic wave filter 12 can comprise a power medium, which in this embodiment is four electrodes 66*a*, 66*b*, 68*a*, 68*b*. An energy source 22 can be electromagnetically coupled to the electrodes 66*a*, 66*b*, 68*a*, 68*b* such that a plasma may be formed in the region of space 18, which can be generated by composition 20. A control mechanism 24 for selecting a power level of the power medium is present such that a plasma density formed will reflect an undesired electromagnetic signal frequency 26 emitted from a remote source, while at the same time allowing desired electromagnetic signal frequency 28, 30 to pass through the electromagnetic wave filter 12. The control mechanism 24 also controls a gas regulator 23. The gas regulator is fluidly coupled to the region of space 18 (which in this embodiment is within an enclosed chamber defined by walls 32). The gas regulator can fluidly communicate with the region of space by a conduit 25 that is further regulated by a valve 27. Any pressure component can be altered such as by adjusting the amount of gas present, or by adjusting the temperature, for example. In this embodiment, the antenna control mechanism 42 and the filter control mechanism 24 are electrically coupled together for intercommunication purposes.

Two different antenna elements are shown, each being protected by the plasma filter 12. One antenna is a standard metal antenna 60 connected to a receiver 62. A second antenna is a plasma antenna 14, also connected to a receiver 44. These antennas can be configured as described previously. Specifically, if a plasma antenna is used, the plasma antenna can comprise an enclosed chamber 34; a composition 36 contained within the enclosed chamber capable of forming a plasma; and a power medium 38 electromagnetically coupled to the composition for developing a plasma density within the enclosed chamber. In one embodiment, the power medium can be coupled to an energy source 40.

The significance of having several electrodes present is that several different plasma paths can be formed. For example, by energizing electrode 66*a* and electrode 66*b*, path 74 is formed that protects primarily the plasma antenna 14. Likewise, by energizing electrode 68*a* and electrode 68*b*, path 72 is formed that protects primarily the metal antenna 60. However if electrode 66*a* and electrode 68*a* (and optionally 66*b* and/or 68*b*) are energized, path 70 is formed that can be used to substantially protect all antenna elements behind the electromagnetic wave filter.

Figure 5:
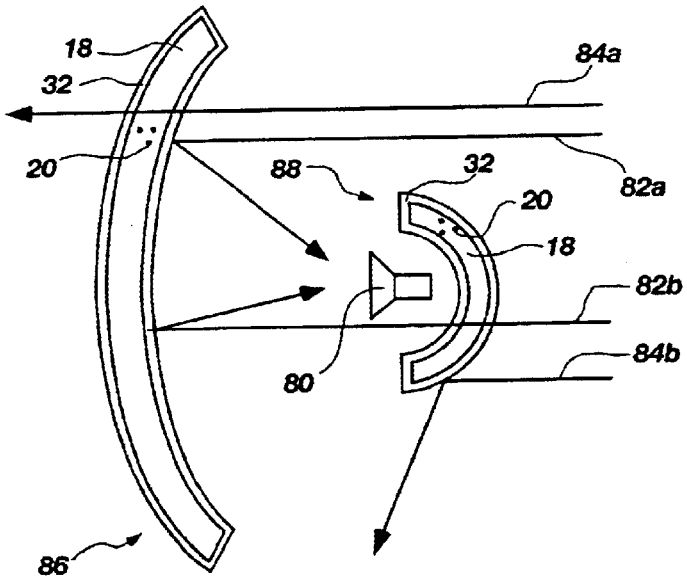
FIG. 5 is a schematic representation of a system which utilizes two electromagnetic wave filters.

Turning now to FIG. 5, an alternative arrangement is shown that utilizes two plasma shields/filters in accordance with an embodiment of the present invention. The plasma shields/filters each comprise a composition 20 capable of forming a plasma and a region of space 18 defined by walls 32. A horn antenna 80 is shown that can be used for receiving or transmitting electromagnetic energy. The system can be configured such that a desired electromagnetic signal 82*a*, 82*b* can be received by the antenna 80 to the exclusion of undesired electromagnetic signal 84*a*, 84*b*. Specifically, the system excludes undesired electromagnetic signal 84*a* from reaching the antenna by allowing the undesired electromagnetic signal 84*a* to pass through a first plasma filter 86, as described previously. Additionally, the antenna 80 is further protected from receiving (non-reflected) undesired electromagnetic signal 84*b* by the presence of a second plasma filter 88. Alternatively, desired electromagnetic signal 82*a* can be reflected from the first plasma filter 86 and focused on the antenna element 80. Further, the second plasma filter 88 can be configured such that desired electromagnetic signal 82*b* can pass therethrough and reflect from the first plasma filter 86 to a receiving location of the antenna 88.

It is understood that the arrangement shown in FIG. 5 is merely one possible arrangement. For example, plasma densities can be modified as described previously to alter the what electromagnetic wave frequencies are reflected and allowed to pass through either of the plasma filters. Alternatively, a plasma antenna can be used rather than the horn antenna element shown. Further, though the power medium, control mechanism, signal receiver/transmitter, gas regulator, etc., are not shown, it is understood that they can be used as described herein.

By way of example, an electromagnetic plasma wave filter, such as that shown previously in FIGS. 1, 3, 4, and 5 can be configured as follows. In one embodiment, a plasma can be formed within an enclosed chamber such that the plasma frequency is $10^9$ Hz. At this plasma frequency, there are approximately $10^{10}$ electrons per cubic centimeter (e/cm$^3$). Also, at this plasma frequency, electromagnetic wave frequencies below $10^8$ Hz will reflect. The skin depth of the plasma will be approximately 5 centimeters in thickness. Thus, an enclosure that is 5 centimeters in width or more can be used effectively. At electromagnetic wave frequencies greater than $10^8$ Hz and less than $10^9$ Hz, partial reflection may occur because somewhere within this range is a transition frequency where some frequencies can penetrate and some will reflect.

To calculate the thickness of the skin depth (s.d.) to be used, the following formula can be used:

$$s.d. = \frac{c}{2\pi(\text{plasma frequency}^2 - \text{transmitter frequency}^2)^{1/2}}$$

where c is the speed of light.

The control mechanism of the plasma antenna and/or the electromagnetic wave filter may be designed to alter any of a number of variables present. For example, the control mechanism can act to control the power medium as to time, e.g., when the control medium is energized, frequency, intensity, which control medium elements are energized, the intensity of energy applied, and other known variables. These variables can alter the plasma frequency or skin depth of the plasma, or can alter the general geometry of the plasma. By modifying the plasma density, the plasma filter and/or plasma antenna can be reconfigured to allow certain frequencies to pass through, be absorbed, or reflect, depending on the specific desired application.

If a plasma antenna element is used with the system of the present invention, one should note that in some ways, these antennas are like standard antenna elements. For example, plasma antennas do not transmit electromagnetic signal without an RF or other emitting signal or source, nor are they useful for signal reception without some type of processor or signal receiver. Therefore, for practical purposes, the plasma antennas are generally electromagnetically coupled to a signal generator and/or a signal receiver. The emitting signal to be transmitted can be RF signal, but can also be any electromagnetic signal known by those skilled in the art. Though the emitting source or receiving device is sometimes separate from the energy source/power medium used to form the plasma, a single device can also be used to carry out both purposes.

A significant advantage to using a plasma antenna within the system of the present invention includes the fact that the plasma antenna has the ability to adapt to different lengths and geometric configurations. Tubes of gas are created in many shapes and are limited only by the dynamics of the material used for construction. In addition, tube lengths or placement of power medium elements can be tailored to any desired harmonic multiplier or the plasma density may be modified to alter the properties of the conductive path. In this way, the antenna may be reconfigurable. Additionally, the use of several radiation patterns are possible without changing the geometry of the enclosed chamber, e.g., by altering the natural plasma frequency. For example, more dense plasma within an enclosed chamber can create properties such as those found in a traveling wave antenna and a less dense plasma can create properties such as those found in a standing wave antenna. In other words, with plasma, the geometry of the enclosed chamber and/or the capacitance and inductance of the plasma may be altered to achieve a desired result. Conversely, with a metal antenna, the antenna geometry is what can primarily can be changed.

As discussed, it is preferred that walls that define the region of space of the electromagnetic wave filter or the enclosed chamber of the plasma antenna are constructed of one or more non-conductive materials so that the chamber does not electromagnetically interfere with the plasma of the electromagnetic wave filter or plasma antenna that is generated. Additionally, though the use of electrodes can be used for the power medium of the electromagnetic wave filter or the plasma antenna, other power medium elements or devices can be used. For example, an inductor can be used at one or more locations, or a non-metal power medium can be used such as lasers, fiber optics, acoustic waves etc. Alternatively, a plasma waveguide device can be used to receive or transmit signal, or feed power to a member of the device to form the plasma, e.g., ionize the composition in the region of space. Such a non-metal design can provide an additional advantage which includes the ability for the antenna system to be invisible to radar when not transmitting or receiving signal. In one embodiment, a system can be developed that has virtually no metal elements, making it more stealth, i.e., plasma shield, plasma antenna, plasma waveguide feeds, etc.

There are many applications of use for the plasma antenna filter system of the present invention. For example, antennas as well as other plasma antennas known in the art could be arranged, preferably in close proximity to one another, to form plasma antenna arrays.

The present invention can be particularly adapted for protection of antenna equipment against electronic warfare. Because of the reconfigurable nature of the electromagnetic wave filter and the plasma antenna, blanket and spot jamming can be more easily avoided. Further, by using an electromagnetic wave filter as disclosed herein, high power low frequency signal can be filtered such that it does not reach the antenna systems it is designed to protect. Thus, high power low frequency signal sent from an enemy that is intended to overload communications or active sensor gear in order to physically damage equipment can also be avoided.

In accordance with the present invention, several exemplary arrangements can be implemented according to the principles of the present invention and are described by way of example. First, a single electromagnetic wave filter can be configured to protect a single antenna element. Such an embodiment is shown in FIG. 1. Second, a single electromagnetic wave filter can be configured to reflect desired electromagnetic energy on a single antenna element. Additionally, a single electromagnetic wave filter can be configured to protect an array of antenna elements, or to reflect electromagnetic waves onto an array of antenna elements. The array of antenna elements can be metal antennas of any known configuration and/or plasma antennas of any known configuration. An example of such an embodiment is shown in FIG. 4. Further, multiple electromagnetic wave filters can configured to protect a single antenna element, e.g. metal antennas, reflector antennas, plasma antennas, etc. FIG. 5 can depict one such arrangement. Still further, multiple electromagnetic wave filters can be configured to protect a plurality of antenna elements, e.g., metal antennas, reflector antennas, plasma antennas, etc. The system shown in FIG. 4, due to its geometric reconfigurability, can be viewed as a single enclosure that acts as multiple electromagnetic wave filters.

In accordance with the principles described herein, a method for selectively receiving an electromagnetic signal from a remote source can comprise the steps of identifying a desired electromagnetic signal frequency to be received from at least one remote source emitting multiple electromagnetic signal frequencies, including the desired electromagnetic signal frequency and at least one undesired electromagnetic signal frequency; generating a plasma that reflects a first electromagnetic signal frequency emitted from the remote source, while at the same time passing a second electromagnetic signal frequency, either the first electromagnetic signal frequency or the second electromagnetic signal frequency being the desired electromagnetic signal frequency; and positioning an antenna with respect to the plasma such that the desired electromagnetic signal frequency is received by the antenna, and the undesired electromagnetic signal frequency is not substantially received by the antenna. In one embodiment, the first electromagnetic signal frequency can be the desired electromagnetic signal frequency. In another embodiment, the second electromagnetic signal frequency can be the desired electromagnetic signal frequency. Further, the first and/or second electromagnetic signal frequency can be a range of electromagnetic signal frequency.

In practicing a method of the present invention, or by utilizing a device of the present invention, electromagnetic signal can be modified upon interaction with a plasma, such as is present in a plasma filter. For example, electromagnetic signal can be phase shifted upon interaction with the plasma It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. An electromagnetic wave filter, comprising:

a power medium positioned with respect to a region of space, wherein the region of space is within an enclosed chamber defined by substantially non-conductive walls, and wherein the enclosed chamber is configured in a shape of a reflector selected from the group consisting of a plane reflector, a curved reflector, and a corner reflector;

a composition disposed within the region of space for forming a plasma;

an energy source electromagnetically coupled to the power medium such that a plasma may be formed in the region of space; and a control mechanism for selecting and regulating plasma density within the region of space to reflect a first electromagnetic signal frequency emitted from a remote source, while at the same time passing a second electromagnetic signal frequency.

2. An electromagnetic wave filter as in claim 1, wherein the control mechanism includes a power regulator configured to vary energy applied at the power medium.

3. An electromagnetic wave filter as in claim 1, wherein the first electromagnetic signal frequency is a desired electromagnetic signal frequency and the second electromagnetic signal frequency is an undesired electromagnetic signal frequency.

4. An electromagnetic wave filter as in claim 1, wherein the control mechanism includes a gas regulator configured to vary the pressure in the enclosed chamber.

5. An electromagnetic wave filter as in claim 1, wherein the first electromagnetic signal frequency is an undesired electromagnetic signal frequency and the second electromagnetic frequency is a desired electromagnetic signal frequency.

6. An electromagnetic wave filter as in claim 1, wherein the curved reflector is parabolic.

7. An electromagnetic wave filter as in claim 1, wherein the plasma fills a portion of the enclosed chamber.

8. An electromagnetic wave filter as in claim 1, wherein the enclosed chamber comprises a dielectric material.

9. An electromagnetic wave filter as in claim 1, wherein the composition is a gas selected from the group consisting of neon, xenon, argon, krypton, hydrogen, helium, and mercury vapor.

10. An electromagnetic wave filter as in claim 1, wherein the power medium is coupled to the region of space at a plurality of locations.

11. An electromagnetic wave filter as in claim 1, wherein the plasma is formed for continuous electromagnetic wave filtration.

12. An electromagnetic wave filter, comprising:

a power medium positioned with respect to a region of space, wherein the region of space is within an enclosed chamber defined by substantially non-conductive walls;

a composition disposed within the region of space for forming a plasma;

an energy source electromagnetically coupled to the power medium such that a plasma may be formed in the region of a space; and a control mechanism for selecting and regulating plasma density within the region of space to reflect a first electromagnetic signal frequency emitted from a remote source, while at the same time passing a second electromagnetic signal frequency, wherein the control mechanism includes a gas regulator configured to vary the pressure in the enclosed chamber.

13. A method for selectively receiving an electromagnetic signal from a remote source, comprising:

identifying a desired electromagnetic signal frequency to be received from at least one remote source emitting multiple electromagnetic signal frequencies, including the desired electromagnetic signal frequency and at least one undesired electromagnetic signal frequency;

generating a plasma that reflects a first electromagnetic signal frequency emitted from the remote source, while at the same time passing a second electromagnetic signal frequency, either the first electromagnetic signal frequency or the second electromagnetic signal frequency being the desired electromagnetic signal frequency; and positioning an antenna with respect to the plasma such that the desired electromagnetic signal frequency is received by the antenna, and the undesired electromagnetic signal frequency is not substantially received by the antenna; and phase shifting the second electromagnetic signal frequency upon interaction with the plasma.

14. An antenna system for receiving an electromagnetic wave, comprising:

a plasma antenna configured for receiving electromagnetic waves; and a plasma filter associated with the plasma antenna and configured for reflecting a first electromagnetic signal frequency emitted from a remote source, while at the same time passing a second electromagnetic signal frequency, such that either the first electromagnetic signal frequency or the second electromagnetic signal frequency is received by the plasma antenna.

15. An antenna system as in claim 14, wherein the first electromagnetic signal frequency is an undesired electromagnetic signal frequency and the second electromagnetic signal frequency is a desired electromagnetic signal frequency, thereby causing said desired frequency passing through the plasma filter to be received by the plasma antenna.

16. An antenna system as in claim 14, wherein the first electromagnetic signal frequency is a desired electromagnetic signal frequency and the second signal electromagnetic frequency is an undesired electromagnetic signal frequency, thereby causing said desired electromagnetic signal frequency reflecting from the plasma filter to be received by the plasma antenna.

17. An antenna system as in claim 14, wherein the plasma antenna is configured for absorbing a desired electromagnetic signal frequency, and is further configured for allowing an undesired electromagnetic signal frequency to pass through.

18. An antenna system as in claim 14, wherein a plurality of electromagnetic wave filters are configured for use with a plurality of antenna elements, including the plasma antenna.

19. An antenna system as in claim 14, wherein the plasma antenna comprises:

an enclosed chamber defined by substantially non-conductive walls;

a composition contained within the enclosed chamber capable of forming a plasma;

a power medium positioned with respect to the composition such that when the power medium is energized, a plasma may be formed;

an antenna energy source coupled to the power medium for energizing the power medium and developing a plasma density within the enclosed chamber; and a signal transmitter or receiver coupled to the plasma.

20. An antenna system as in claim 19, wherein the plasma density is modifiable by an antenna control mechanism.

21. An antenna system as in claim 20, wherein the antenna control mechanism includes a power regulator configured to vary energy applied at the power medium.

22. An antenna system as in claim 20, wherein the antenna control mechanism includes a gas regulator configured to vary the pressure in the enclosed chamber.

23. An antenna system as in claim 14, wherein the plasma filter comprises:

a power medium positioned with respect to a region of space;

a composition disposed within the region of space for forming a plasma; and an energy source electromagnetically coupled to the power medium such that a plasma may be formed in the region of space.

24. An antenna system as in claim 23, wherein the region of space is within an enclosed chamber defined by substantially non-conductive walls.

25. An antenna system as in claim 23, wherein the plasma density is modifiable by a filter control mechanism.

26. An antenna system as in claim 25, wherein the filter control mechanism includes a power regulator configured to vary energy applied at the power medium.

27. An antenna system as in claim 25, wherein the region of space is within an enclosed chamber and the filter control mechanism includes a gas regulator configured to vary the pressure in the enclosed chamber.

28. An antenna system as in claim 14, wherein the plasma antenna comprises an antenna control mechanism for selecting an antenna plasma density, and wherein the plasma filter comprises a filter control mechanism for selecting a filter plasma density.

29. An antenna system as in claim 28, wherein the antenna control mechanism and the filter control mechanism are electrically coupled together for intercommunication.

30. An antenna system as in claim 14, wherein the electromagnetic wave filter is configured for use with a plurality of antenna elements, including the plasma antenna.

31. An antenna system as in claim 14, wherein a plurality of electromagnetic wave filters are configured for use with the plasma antenna.

32. A method for selectively receiving an electromagnetic signal from a remote source, comprising:

identifying a desired electromagnetic signal frequency to be received from at least one remote source emitting multiple electromagnetic signal frequencies, including the desired electromagnetic signal frequency and at least one undesired electromagnetic signal frequency;

generating a plasma that reflects a first electromagnetic signal frequency emitted from the remote source, while at the same time passing a second electromagnetic signal frequency, either the first electromagnetic signal frequency or the second electromagnetic signal frequency being the desired electromagnetic signal frequency; and positioning an antenna with respect to the plasma such that the desired electromagnetic signal frequency is received by the antenna, and the undesired electromagnetic signal frequency is not substantially received by the antenna, and wherein the antenna is a plasma antenna.

* * * * *